US006144833A

United States Patent [19]

Ito et al.

[11] Patent Number: 6,144,833

[45] Date of Patent: Nov. 7, 2000

[54] FIXING DEVICE

[75] Inventors: Tetsuro Ito, Anjo; Mitsuru Isogai, Aichi-Ken, both of Japan

[73] Assignee: Minolta Co., Ltd., Osaka, Japan

[21] Appl. No.: 09/405,014

[22] Filed: Sep. 27, 1999

[30] Foreign Application Priority Data

Sep. 28, 1998 [JP] Japan ..... 10-273599
Aug. 5, 1999 [JP] Japan ..... 11-222360

[51] Int. Cl.[7] ..... G03G 15/20

[52] U.S. Cl. ..... 399/328; 219/216; 219/469; 399/333

[58] Field of Search ..... 399/328, 330, 399/331, 333, 320; 219/216, 243, 469; 430/99, 124; 118/60

[56] References Cited

U.S. PATENT DOCUMENTS

Re. 33,770 12/1991 Torino et al. ..... 219/469 X
4,842,944 6/1989 Kuge et al. ..... 219/216 X
5,157,445 10/1992 Shoji et al. ..... 399/331 X
5,289,246 2/1994 Menjo ..... 399/333
5,315,359 5/1994 Nishikawa ..... 399/328 X
5,481,349 1/1996 Satoh et al. ..... 399/328
5,570,171 10/1996 Kusumoto et al. ..... 399/328

*Primary Examiner*—Sophia S. Chen
*Attorney, Agent, or Firm*—McDermott, Will & Emery

[57] ABSTRACT

A fixing device has first and second rollers respectively formed of a metallic cylindrical body provided with an elastic member. The rollers are abutted against each other so that the elastic members contact each other. The fixing device further has a heater for heating at least one of the rollers and a driver for rotating at least one of the rollers so that a transfer sheet passes through contact portion of the rollers. Roller hardness of the first roller is smaller than that of the second roller, and density of cross-link of the elastic member of the first roller is lower than that of the elastic member of the second roller.

14 Claims, 9 Drawing Sheets

FIXING DEVICE

This application is based on applications Nos. 10-273599 and 11-222360 filed in Japan, the contents in which are hereby incorporated by reference.

BACKGROUND OF THE INVENTION

The present invention relates to a fixing device used in an image forming apparatus of electrophotographic type such as a copying machine, printer or facsimile, wherein fixing is performed by heating and melting a developer image that has been transferred from a surface of an image bearing body onto a transfer sheet such as transfer paper or overhead projector transparency.

A known fixing device of this type as shown in FIG. 12 is comprised of a pair of rollers 3,4 each obtained by forming an elastic member 2 around an outer periphery of a metallic cylindrical body 1, heaters 5 for heating these rollers 3,4 and a driver 6 for rotating at least one of the rollers 3,4. The metallic cylindrical body 1 and the elastic member 2 are generally of same material for both of the pair of rollers 3,4 and they are designed so that their outer diameter and thickness of the elastic member 2 are identical. These rollers 3,4 forming a pair are abutted against each other, and a transfer sheet 8 is delivered through their contact portion (nip portion 7) wherein developer is melted at this nip portion 7 to be fixed onto the transfer sheet 8. In case materials and sizes of the pair of rollers 3,4 are identical, the nip portion 7 has a flat initial shape.

In this fixing device, the elastic member 2 of each of the rollers 3,4 is thermally deteriorated owing to heat generated by the heater 5 so that the hardness thereof is decreased. Since unevenness in components of the elastic member 2 of each of the rollers 3,4 is inevitable, the degree of decrease of hardness owing to thermal deterioration also varies between the rollers 3,4.

For instance, in case the degree of decrease of hardness owing to thermal deterioration of the elastic member 2 of the roller 3 on the upper side is larger than that of the elastic member 2 of the roller 4 on the lower side in the example of FIG. 12, the nip portion 7 forms an upwardly convex shape as indicated by the one dot chain line. On the other hand, in case the degree of decrease of hardness owing to thermal deterioration of the elastic member 2 of the roller 4 on the lower side is larger than that of the elastic member 2 of the roller 3 on the upper side in the example of FIG. 12, the nip portion 7 forms a downwardly convex shape as indicated by the two dot chain line.

In case such a deformation of the nip portion 7 owing to differences in degree of decrease of hardness owing to thermal deterioration of the elastic member 2 of the rollers 3, 4 occurs, it may cause difficult to make the transfer sheet 8 smoothly pass through the rollers 3,4 so that deficiencies in sheet delivery are generated.

Further, due to the fact that it is difficult to know variations in compositions of the elastic members 2 prior to use, it is hard to predict whether the nip portion 7 becomes upwardly convex owing to the differences in decrease of hardness owing to thermal deterioration.

On the other hand, in general, when transfer sheets are successively delivered to the fixing device, heat on the roller surface is captured by the transfer sheet. However, time lags exist between the heat capturing by the transfer sheets and heat supplying from the heaters. Thus, the temperature of the roller surface decrease at the time of starting successive delivery of the transfer sheets. When the degree of temperature decrease at the time of starting successive delivery of sheets differs between each of the pair of rollers, a difference in temperature is generated between the rollers so that this may cause deficiencies in fixing or sheet delivery.

SUMMARY OF THE INVENTION

The present invention has been made with the aim of solving above-mentioned problems of the conventional fixing devices. It is an object of the invention to prevent deficiencies in sheet delivery owing to deformation of the nip portion which is caused by thermal deterioration of the elastic member. It is another object of the present invention to prevent deficiencies in fixing or sheet delivery owing to differences in degree of temperature decrease at the time of starting successive sheet delivery between the pair of rollers.

For solving the first object, a first aspect of the invention provides a fixing device comprising a first and second roller respectively formed of a metallic cylindrical body provided with an elastic member on an outer periphery thereof, the rollers being abutted against each other so that the elastic members contact each other; a heater for heating at least one of the first and second rollers; and a driver for rotating at least one of the first and second rollers so that a transfer sheet passes through a contact portion of the first and second rollers, wherein roller hardness of the first roller is smaller than that of the second roller, and density of cross-link of the elastic member of the first roller is lower than that of the elastic member of the second roller.

In the fixing device according to the first aspect of invention, since the roller hardness of the first roller is smaller than that of the second roller, the contact portion in an initial condition is convex towards a side of the first roller. Further, since the density of cross-link of the elastic member of the first roller is lower than that of the elastic member of the second roller, the decrease of hardness due to thermal deterioration owing to heat generated by the heating means is larger in the elastic member of the first roller than that in the elastic member of the second roller. Therefore, even in case decrease of hardness owing to thermal degradation occurs in the first and second rollers, the relationship of the degree of hardness between the first and second rollers is maintained so that deformation of the contact portion can be prevented. Accordingly, the fixing device of the present invention is capable of preventing deficiencies in sheet delivery owing to decrease in hardness due to the thermal deterioration in elastic members of the first and second rollers.

It is preferable that a thickness of the elastic member of the first roller is larger than that of the elastic member of the second roller.

It is preferable that thermal conductivity of the elastic member of the first roller is larger than that of the elastic member of the second roller.

In this case, the temperature decrease of elastic members of the first and second rollers at the time of starting successive sheet delivery will be of same level, and deficiencies in fixing or sheet delivery owing to temperature difference between the first and second rollers can be prevented.

More particularly, it preferable that outer diameters of the first and second rollers are identical, the thermal conductivity K of the elastic member having larger thickness t of the first roller and the thermal conductivity K' of the elastic member having smaller thickness t' of the second roller are not less than $1.2\times10^{-3}$ (cal/cm·sec·deg) and not more than $2.4\times10^{-3}$ (cal/cm·sec·deg), and the following relationship is satisfied:

$$K'=K-a(t-t'),$$

where $0.257\leqq a$.

It is preferable that hardness of the elastic members of the first and second rollers is not more than 70 according to the JIS standard.

It is preferable that the fixing device further comprises a switching mechanism switching the first and second rollers between an abutted condition in which they are abutted against each other and a separate condition in which they are separated from each other.

By the provision of such a switching mechanism, the first and second rollers may be separated from each other when they are not used to eliminate abutting force exerting on the elastic members of the first and second rollers. Thus, degradation in characteristics of the elastic members can be prevented, resulting in more reliable maintaining the shape of the contact portion.

It is preferable that the switching mechanism is provided with a contact width adjusting mechanism for maintaining a width of the contact portion of the first and second rollers constant.

By the provision of such a contact width adjusting mechanism, the shape of the contact portion of the first and second rollers can be more reliably maintained constant.

For solving the second object, a second aspect of the invention provides a fixing device comprising: a first and second roller respectively formed of a metallic cylindrical body provided with an elastic member on an outer periphery thereof, the rollers being abutted against each other so that the elastic members contact each other; a heater for heating at least one of the first and second rollers; and a driver for rotating at least one of the first and second rollers so that a transfer sheet passes through a contact portion of the first and second rollers, wherein thermal conductivity of the elastic member of the first roller is larger than that of the elastic member of the second roller.

By setting the thermal conductivity of the elastic members of the first and second rollers as above, the degree of temperature decrease of elastic members of the first and second rollers at the time of starting successive sheet delivery will be of same level. Thus, deficiencies in fixing or sheet delivery owing to temperature differences between the first and second rollers can be prevented.

It is preferable that a thickness of the elastic member of the first roller is larger than that of the elastic member of the second roller.

More particularly, it is preferable that outer diameters of the first and second rollers are identical, the thermal conductivity K of the elastic member having larger thickness t of the first roller and the thermal conductivity K' of the elastic member having smaller thickness t' of the second roller are not less than $1.2\times10^{-3}$ (cal/cm·sec·deg) and not more than $2.4\times10^{-3}$ (cal/cm·sec·deg), and the following relationship is satisfied:

$$K'=K-a(t-t'),$$

where $0.257\leqq a$.

The third aspect of the invention provides a pair of rollers employed in a fixing device for fixing developer onto a transfer sheet by heating the transfer sheet supporting the developer, comprising: a first roller formed of a metallic cylindrical body provided with an elastic member on an outer surface thereof; and a second roller formed of a metallic cylindrical body provided with an elastic member on an outer surface thereof, the second roller being abutted against the first roller so that a nip portion is formed through which the transfer sheet is passed, wherein roller hardness of the first roller is smaller than that of the second roller, and density of cross-link of the elastic member of the first roller is lower than that of the elastic member of the second roller.

It is preferable that a thickness of the elastic member of the first roller is larger than that of the elastic member of the second roller.

It is preferable that thermal conductivity of the elastic member of the first roller is larger than that of the elastic member of the second roller.

More particularly, it is preferable that outer diameters of the first and second rollers are identical, the thermal conductivity K of the elastic member having larger thickness t of the first roller and the thermal conductivity K' of the elastic member having smaller thickness t' of the second roller are not less than $1.2\times10^{-3}$ (cal/cm·sec·deg) and not more than $2.4\times10^{-3}$ (cal/cm·sec·deg), and the following relationship is satisfied:

$$K'=K-a(t-t'),$$

where $0.257\leqq a$.

It is preferable that hardness of the elastic members of the first and second rollers is not more than 70 according to the JIS standard.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

First Embodiment

Figure 1:
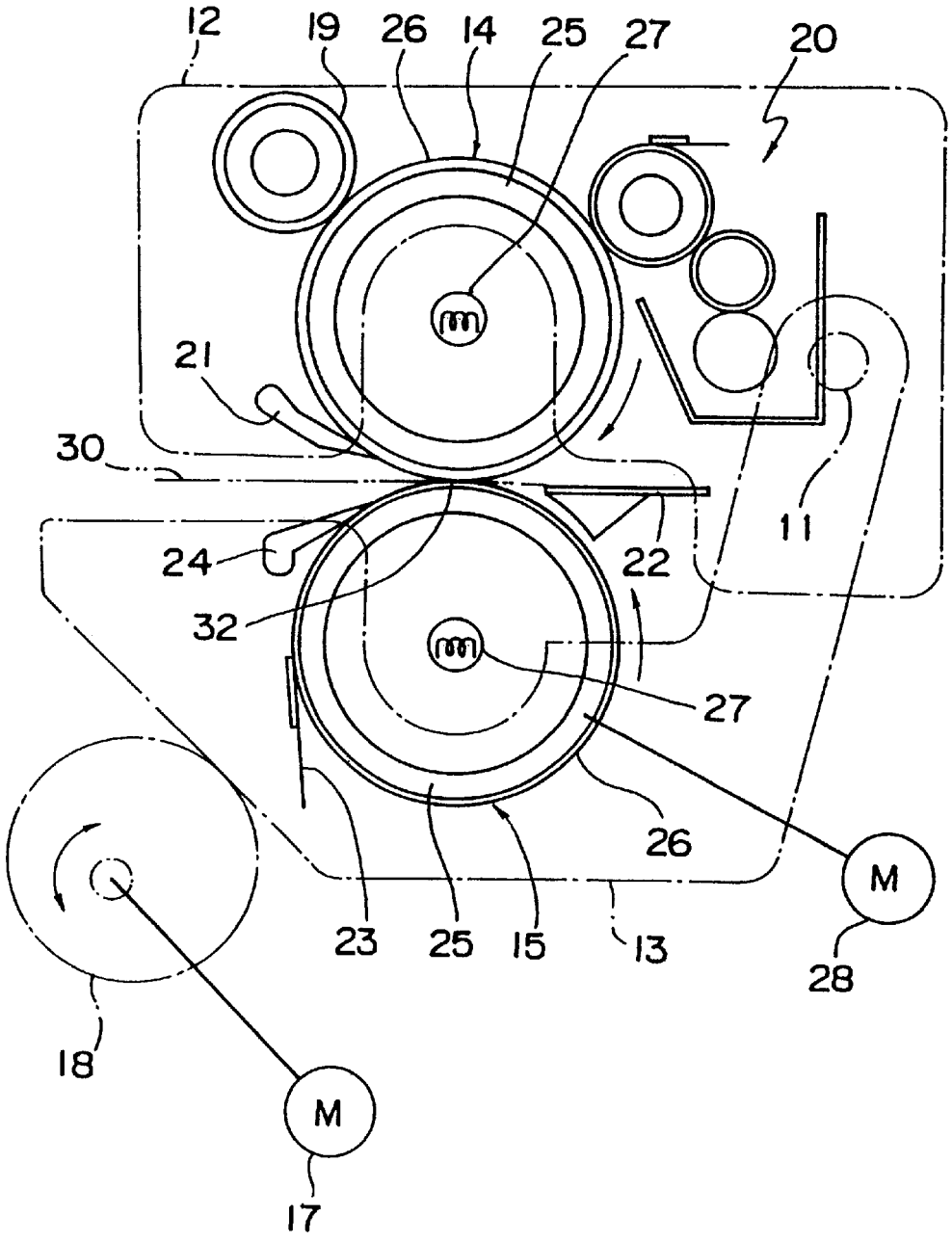
FIG. 1 is a schematic structural view showing the fixing device according to the first embodiment of the present invention.
Figure 2A:
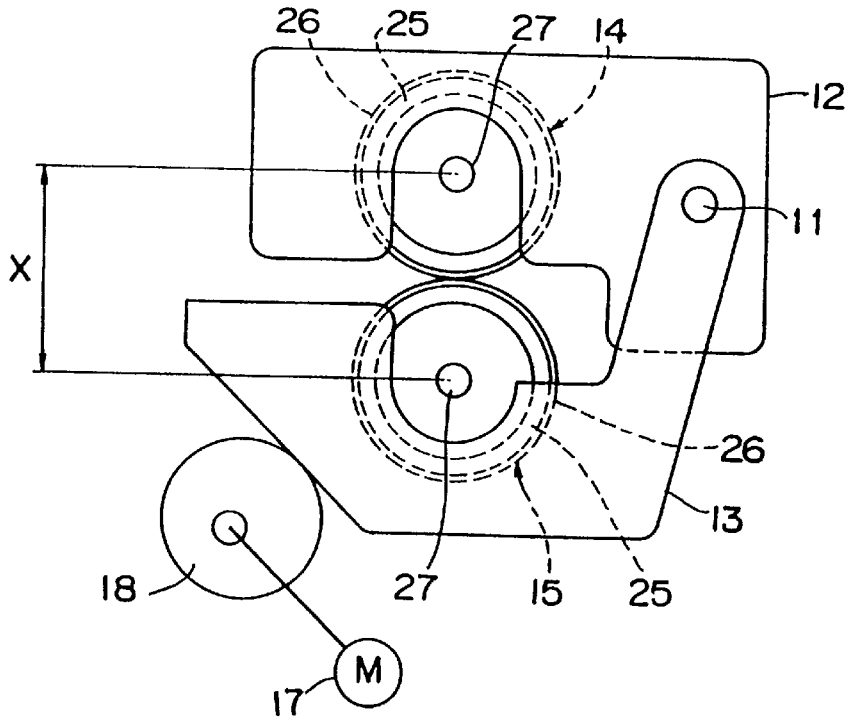
FIG. 2A is a schematic view showing the fixing device in an abutted condition.
Figure 2B:
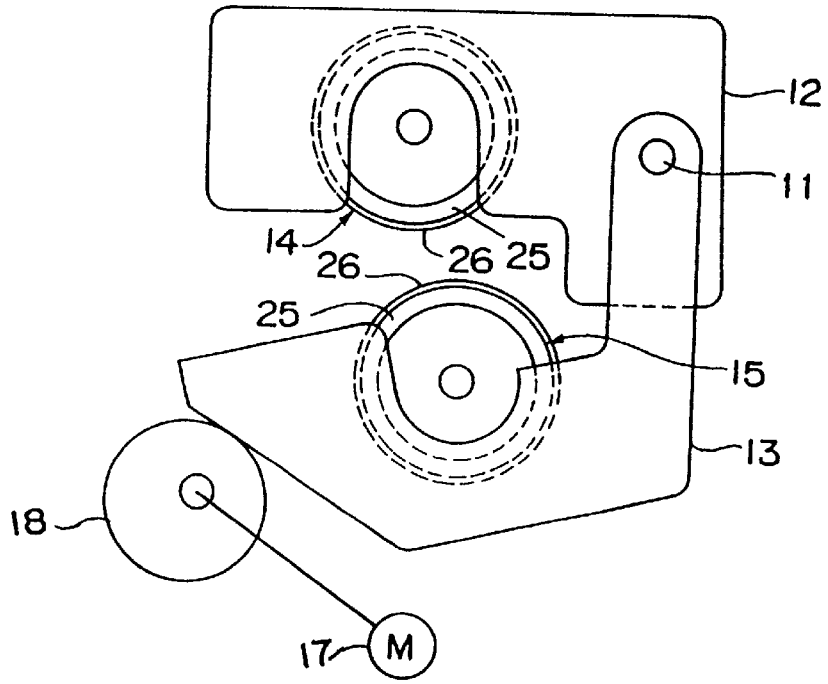
FIG. 2B is a schematic view showing the fixing device in a separate condition.

A fixing device according to a first embodiment of the invention as shown in FIGS. 1 and 2 comprises an upper frame 12 and a lower frame 13 that are connected to each other with a supporting pin 11. A fixing roller 14 is supported by the upper frame 12 in a rotatable manner, and a pressure roller 15 is supported by the lower frame 13 in a rotatable manner.

An eccentric cam 18 that is driven by a motor 17 is abutted against the lower frame 13. By changing angles of rotation of the eccentric cam 18, it is enabled to switch between an abutted condition in which the fixing roller 14 and pressure roller 15 are abutted against each other as shown in FIG. 2A, and a separate condition in which the fixing roller 14 and the pressure roller 15 are separated from each other. Further, by adjusting the angle of rotation of the cam 18, a distance X between axes of the fixing roller 14 and pressure roller 15 (as shown in FIG. 2A) can be maintained constant and thus to maintain a width of a later-mentioned nip portion 32 constant. The motor 17 and eccentric cam 18 constitute a switching mechanism and a contact width adjusting mechanism of the present invention.

In addition to the fixing roller 14, there are further provided at the upper frame 12 a cleaning roller 19, an oil applying mechanism 20 and a separator 21. At the lower frame 13, there are provided a pre-fixing guide 22, an oilscraping blade 23 and a separator 24.

The fixing roller 14 and pressure roller 15 are respectively formed of a metallic cylindrical body 25 provided with a silicon rubber layer 26 which serves as an elastic member on an outer periphery surface thereof. In an interior of each of the metallic cylindrical bodies 25, there is accommodated a heater 27. A motor 28 that serves as a driver is connected to the pressure roller 15. When the motor 28 is actuated in the abutted condition as shown in FIG. 2A, the pressure roller 15 rotates in a counter-clockwise direction in the drawing and the fixing roller 14 is rotated in a following manner.

Figure 3:
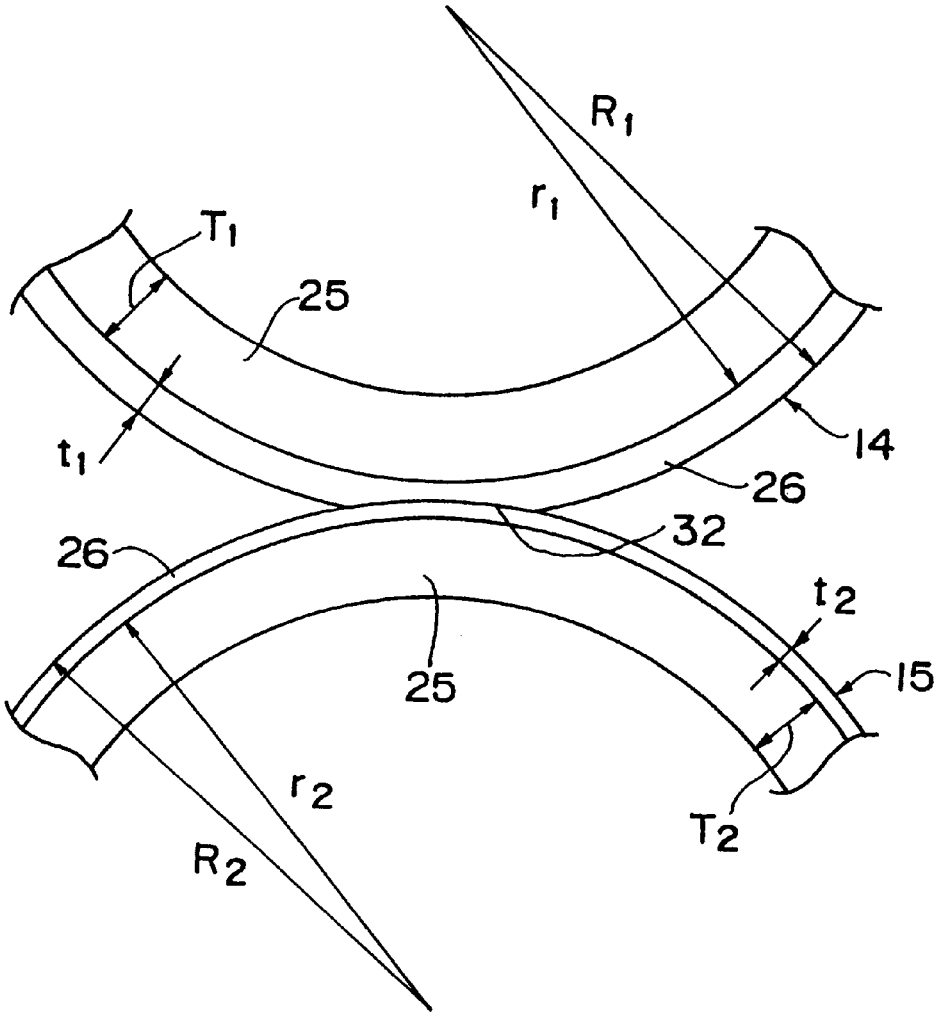
FIG. 3 is a partially enlarged view showing a fixing roller and a pressure roller in abutted condition.

As shown in FIG. 3, the outer diameters R1, R2 of the fixing roller 14 and the pressure roller 15 are identical. The thickness T1, T2 as well as materials of each of the metallic cylindrical bodies 25 of the fixing roller 14 and pressure roller 15 are identical.

The outer diameter r1 of the metallic cylindrical body 25 of the fixing roller 14 is set to be smaller than the outer diameter r2 of the metallic cylindrical body 25 of the pressure roller 15. Since the outer diameters R1, R2 of the fixing roller 14 and pressure roller 15 are identical as already mentioned, the thickness t1 of the silicon rubber layer 26 of the fixing roller 14 is larger than the thickness t2 of the silicon rubber layer 26 of the pressure roller 15 by the difference between the outer diameters r1, r2 of the respective metallic cylindrical bodies 25.

Material values of each of the silicon rubber layers 26 of the fixing roller 14 and the pressure roller 15 are set to be different.

First, a density of cross-link of the silicon rubber layer 26 provided with the fixing roller 14 is set to be smaller than that of the silicon rubber layer 26 provided with the pressure roller 15.

Figure 4:
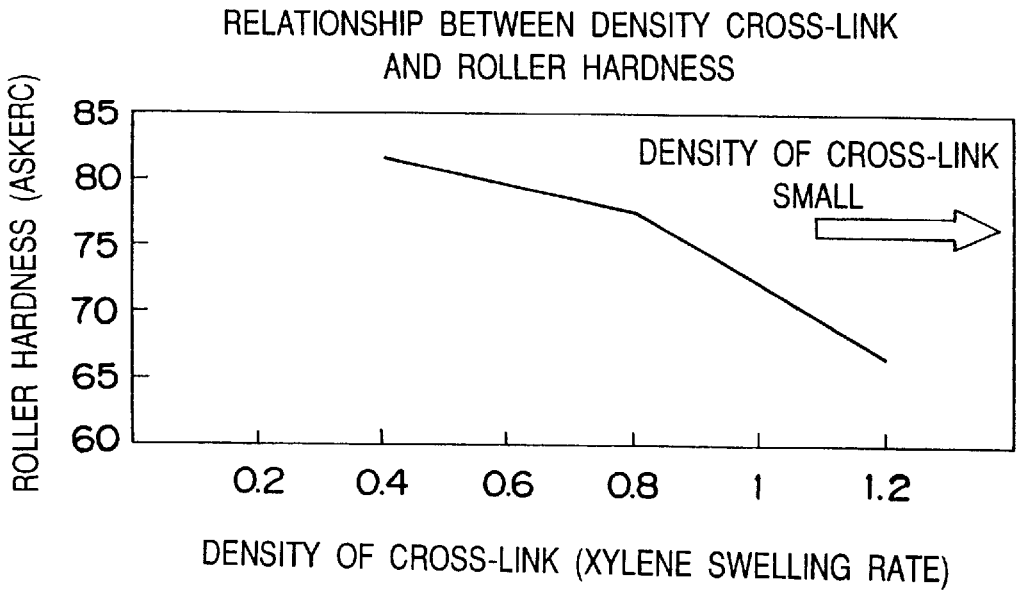
FIG. 4 is a diagram showing a relationship between density of cross-link and hardness of a silicon rubber layer.

FIG. 4 shows a relationship between density of cross-link of the elastic member (in the present embodiment, the silicon rubber layer 26) of the rollers and hardness of the rollers (wherein the outer diameter of the roller is 60 mm, the thickness of the silicon rubber layer is 2 mm, and the amount of additives (fillers) that are added to the silicon rubber layer is 35 volume ratio). As it can be understood from this FIG. 4, in case the diameters of the rollers, as well as the material, thickness and amount of additives for the elastic members are identical, the roller hardness becomes higher the higher the density of cross-link of the elastic member becomes. Further, in general, in case that the materials of the elastic members are identical, its hardness becomes higher the smaller its thickness becomes, whereby the roller hardness is also increased.

Thus, in this embodiment, the roller hardness of the pressure roller 15 is higher than that of the fixing roller 14.

It should be noted that the density of cross-link has been evaluated by a xylene swelling rate that is defined by the following equation. The roller hardness has been evaluated based on JIS C 2123.

$$\text{(Xylene Swelling rate)}=\text{(weight of xylene impregnated condition)}-\text{(weight after drying)}/\text{(weight after drying)}\times 100$$

Figure 5:
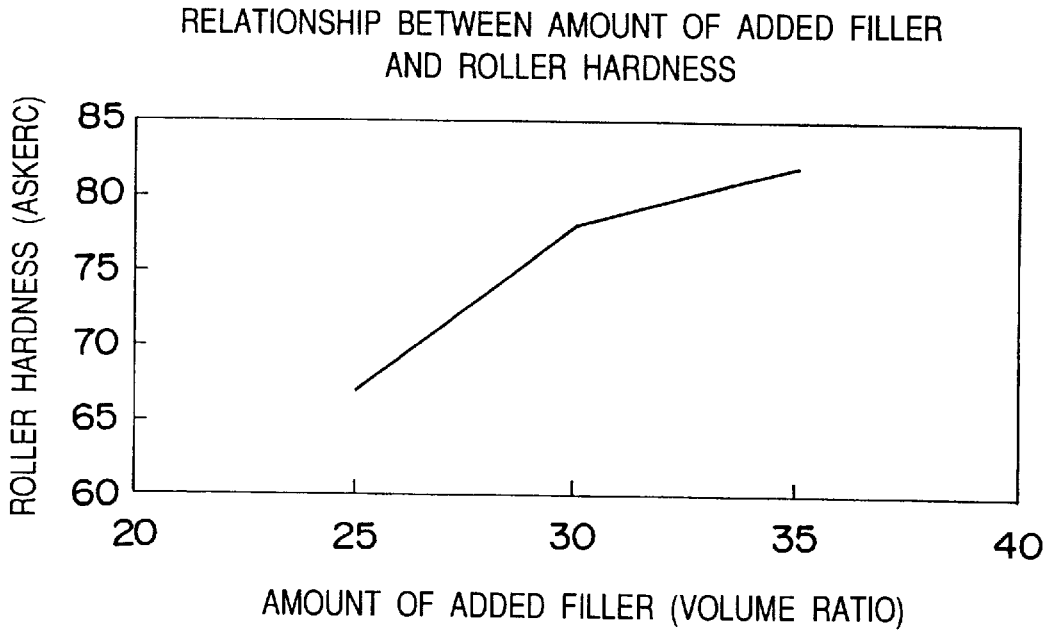
FIG. 5 is a diagram showing a relationship between amount of addition of fillers and hardness of rollers.

The hardness of the elastic members is also varied by the amount of additives that is added to the elastic member. FIG. 5 is a view showing influences of amounts of filler on the roller hardness in case filler is added as an additive to the silicon rubber layer (wherein the outer diameter of the roller is 60 mm, the thickness of the silicon rubber layer is 2 mm, and the density of cross-link (xylene swelling rate) is 0.5). As it can be understood from this FIG. 5, the roller hardness becomes higher the more the amount of filler to be added is increased.

While filler is added to the silicon rubber layer 26 for adjusting thermal conductivity as it will be described later, the amount of addition is adjusted such that above-mentioned relationship between respective roller hardness of the fixing roller 14 and pressure roller 15 is not changed.

Figure 6:
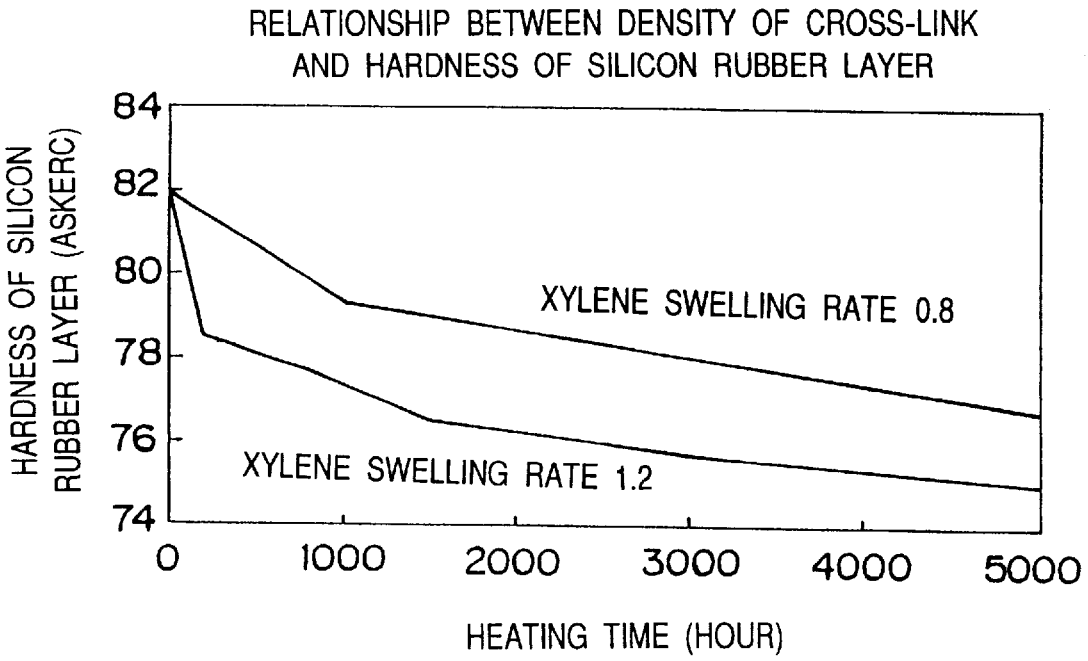
FIG. 6 is a diagram showing a relationship between heating time and hardness of the silicon rubber layer.

As shown in FIG. 6, the hardness of the silicon rubber layer 26 is decreased owing to thermal deterioration caused through heat generated by the heater 27. The degree of decrease of the hardness owing to thermal deterioration becomes larger the lower the density of cross-link is. Thus, the degree of decrease of the hardness owing to thermal deterioration of the silicon rubber layer 26 of the fixing roller 14 is larger than that of the silicon rubber layer 26 of the pressure roller 15.

In consideration of fixing characteristics of developer with respect to the transfer sheet 30, the hardness of each of the silicon rubber layers 26 of the fixing roller 14 and pressure roller 15 is preferably set to be not more than 70 based on the above mentioned JIS C 2123.

Owing to the above fact that the roller hardness of the fixing roller 14 is smaller than the roller hardness of the pressure roller 15, the nip portion 32 forms a convex shape towards a side of the fixing roller 14, that is, to an upward side in the drawing.

When using this fixing device over a long time, the hardness of the silicon rubber layers 26 of the fixing roller 14 and pressure roller 15 are decreased owing to thermal deterioration caused by heat supplied from the heater 27. However, since the degree of decrease of hardness owing to thermal deterioration of the silicon rubber layer 26 of the fixing roller 14 is larger than that of the silicon rubber layer 26 of the pressure roller 15 (wherein the former presents a smaller hardness at the initial state and the latter a larger hardness at the initial state), the relationship between roller hardness of the fixing roller 14 and pressure roller 15 is maintained. Consequently, the shape of the nip portion 32 that is convex in an upward direction in the drawing is maintained, so that deficiencies in sheet delivery owing to deformation of the nip portion 32 can be prevented.

Further, in this embodiment, the thermal conductivity $K_1$ of the silicon rubber layer 26 of the fixing roller 14 having a large thickness is set to be larger than the thermal conductivity $K_2$ of the silicon rubber layer 26 of the pressure roller 15 having a small thickness.

Figure 7:
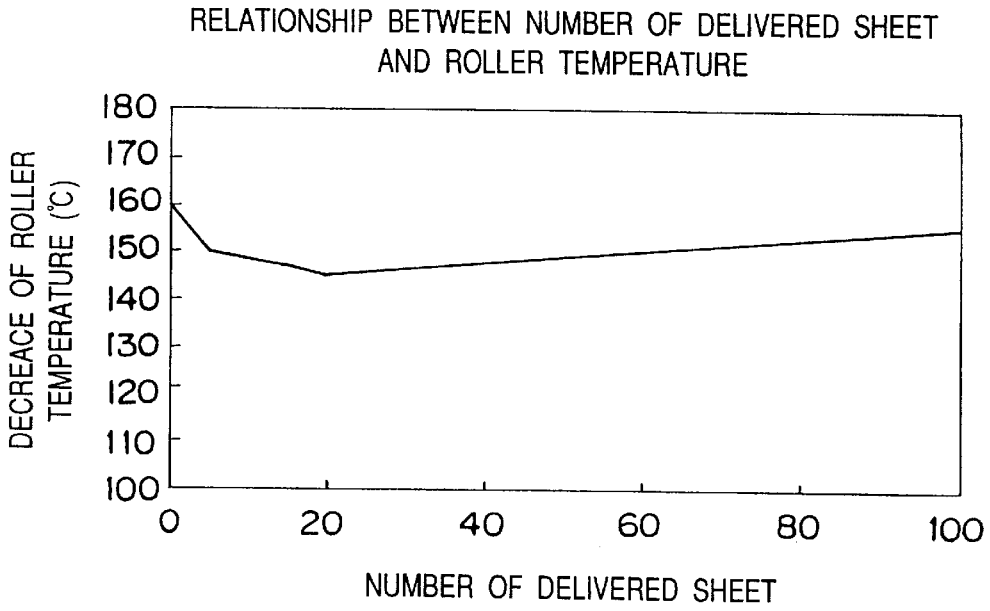
FIG. 7 is a diagram showing a relationship between number of delivered sheets and temperature of rollers.

In case transfer sheets 30 are successively delivered to the fixing device, heat on the surface of the silicon rubber layers 26 of the fixing roller 14 and pressure roller 15 is captured by the transfer sheets 30. While heat is supplied towards the surfaces of the silicon rubber layer 26 through the metallic cylindrical body 25 from the heater 27, a time lag exists until heat is transmitted to the surface since the thermal conductivity of the silicon rubber layer 26 is small. Consequently, as shown in FIG. 7, the surface temperature (temperature of the roller) of the fixing roller 14 and pressure roller 15 is temporally decreased at the time of starting successive delivery of sheets.

Figure 8:
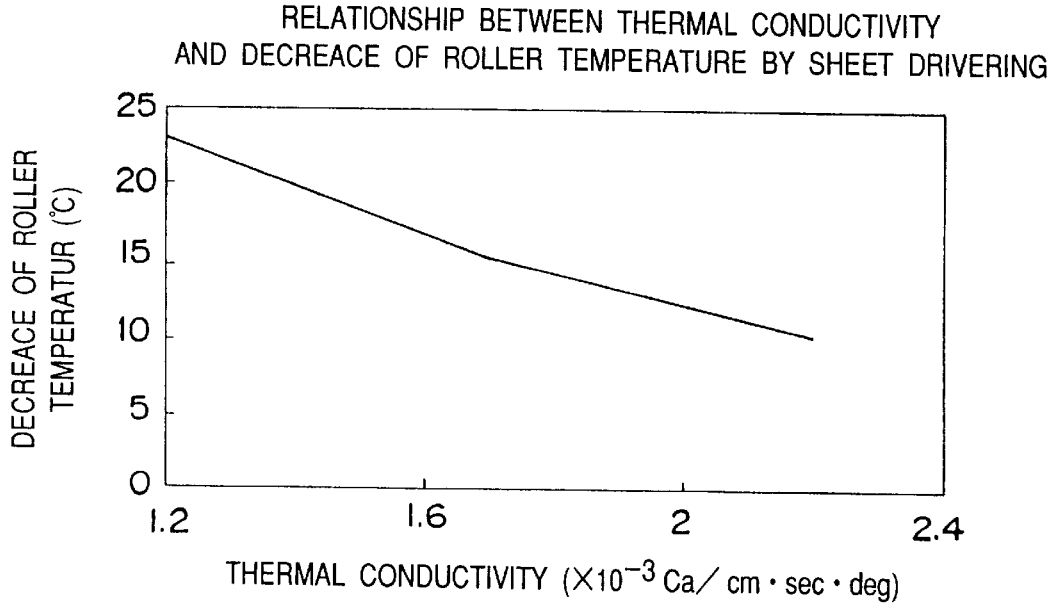
FIG. 8 is a diagram showing a relationship between thermal conductivity and temperature decrease of the silicon rubber layer.

As shown in FIG. 8, this temperature decrease at the time of starting successive delivery of the transfer sheets becomes smaller the higher the thermal conductivity of the silicon rubber layer 26 is. This is because heat can be rapidly supplied from the heater 27 to the surface of the silicon rubber layer 26 in case the thermal conductivity is high.

Figure 9:
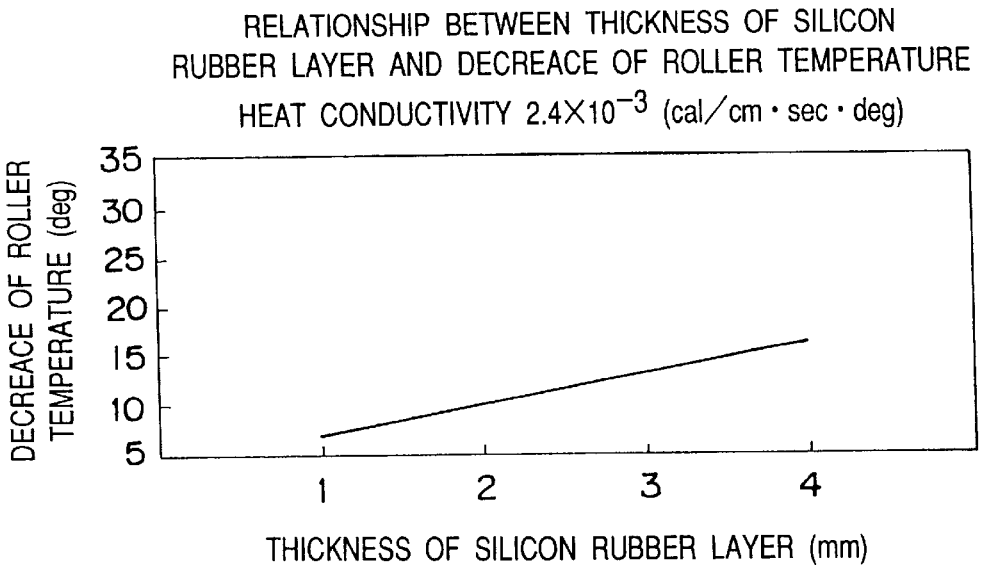
FIG. 9 is a diagram showing a relationship between thickness of the silicon rubber layer and temperature decrease of the rollers.
Figure 10:
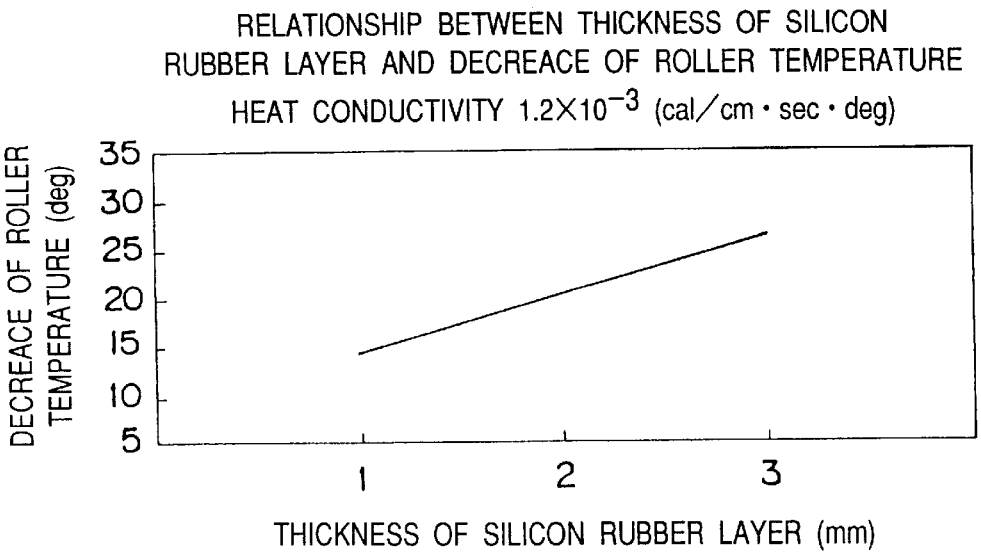
FIG. 10 is a diagram showing a relationship between thickness of the silicon rubber layer and temperature decrease of the rollers.

As shown in FIGS. 9 and 10, in case the thermal conductivity is identical, the degree of temperature decline of the roller at the time of starting successive delivery of sheets is larger the larger the thickness of the silicon rubber layer is. This is because the time required for heat supplied from the heater 27 to reach the surface of the silicon rubber layer 26 becomes longer the larger the thickness becomes in case the thermal conductivity is identical.

Since the thickness t1 of the silicon rubber layer 26 of the fixing roller 14 is set to be larger than the thickness t2 of the silicon rubber layer 26 of the pressure roller 15, a heat moving speed on the silicon rubber layer 26 of the fixing roller 14 is increased by setting the thermal conductivity $K_1$ of the silicon rubber layer 26 of the fixing roller 14 to be larger than the thermal conductivity $K_2$ of the silicon rubber layer 26 of the pressure roller 15. Thus, the temperature difference between the fixing roller 14 and pressure roller 15 owing to decrease in the temperature of rollers at the time of starting successive delivery of the transfer sheets is prevented. Accordingly, in the fixing device of this embodiment, deficiencies of fixing and delivery of the transfer sheets owing to the temperature difference are prevented.

Particularly, the thermal conductivity $K_1$, $K_2$ of the silicon rubber layers 26 is set to be not less than $1.2\times10^{-3}$ (cal/cm·sec·deg) and not more than $2.4\times10^{-3}$ (cal/cm·sec·deg) and to satisfy the following relationship of equation (1):

$$K_2=K_1-a(t_1-t_2),$$

where $0.257 \leqq a$.

The above constant "a" has been obtained in the following manner.

In case the thermal conductivity $K_1$ of the silicon rubber layer 26 of the fixing roller 14 is a maximum value $2.4\times10^{-3}$ (cal/cm·sec·deg) which is in the range of not less than $1.2\times10^{-3}$ (cal/cm·sec·deg) and not more than $2.4\times10^{-3}$ (cal/cm·sec·deg), the temperature decrease $y_1$ of the fixing roller 14 is given by the following equation (2) as it can be seen from the graph of FIG. 9.

$$y_1=3t_1+4 \tag{2}$$

The temperature decrease $y_2$ of the pressure roller 15 is given by the following equation (3).

$$y_2=\alpha(3t_2+4) \tag{3}$$

Wherein ($\alpha=K_1/K_2$)

Where the right-hand sides of the equation (2) and equation (3) are equal, it can be obtained for equation (4).

$$t_1=(K_1/K_2)t_2+(4/3)(K_1/K_2-1) \tag{4}$$

By substituting this equation (4) to equation (1), the following equation (5) can be obtained.

$$a=3K_2/(3t_2+4) \tag{5}$$

Next, considering an internal temperature of the silicon rubber layer 26 of the fixing roller 14, the increase of internal temperature per 1 mm is 7.5° C. in case the thermal conductivity $K_1$ is $2.4\times10^{-3}$ (cal/cm·sec·deg) On the other hand, since the fixing temperature is generally set in the range of 150 to 160° C., the maximum increase in internal temperature is 60° C. in case an upper limit for the internal temperature of the silicon rubber layer 26 is set at 210° C. Thus, the maximum value for the thickness $t_1$ will be 8 mm in this case. In case the thermal conductivity $K_2$ of the pressure roller 15 is set to be minimum, that is, $1.2\times10^{-3}$ (cal/cm·sec·deg), $t_2$=10/3 can be obtained by substituting, to the above equation (4), $K_1=2.4\times10^{-3}$, $K_2=2.4\times10^{-3}$ and $t_1$=8. By substituting, to the equation (5), $t_2$=10/3 as well as $K_2$=1.2 for calculating a minimum value for "a", a≈0.257 can be obtained.

In a concrete example of this first embodiment, the outer diameters $R_1$, $R_2$ of the fixing roller 14 and pressure roller 15 may be set to 60 mm, the thickness t1 of the silicon rubber layer 26 of the fixing roller 14 to 4 mm, the xylene swelling rate to 0.4, and the thermal conductivity $K_1$ to $2.2\times10^{-3}$ (cal/cm·sec·deg), while the thickness $t_2$ of the silicon rubber layer 26 of the pressure roller 15 may be set to 1.6 mm, the xylene swelling rate to 1.2, and the thermal conductivity $K_2$ to $1.2\times10^{-3}$ (cal/cm·sec·deg).

Second Embodiment

Figure 11:
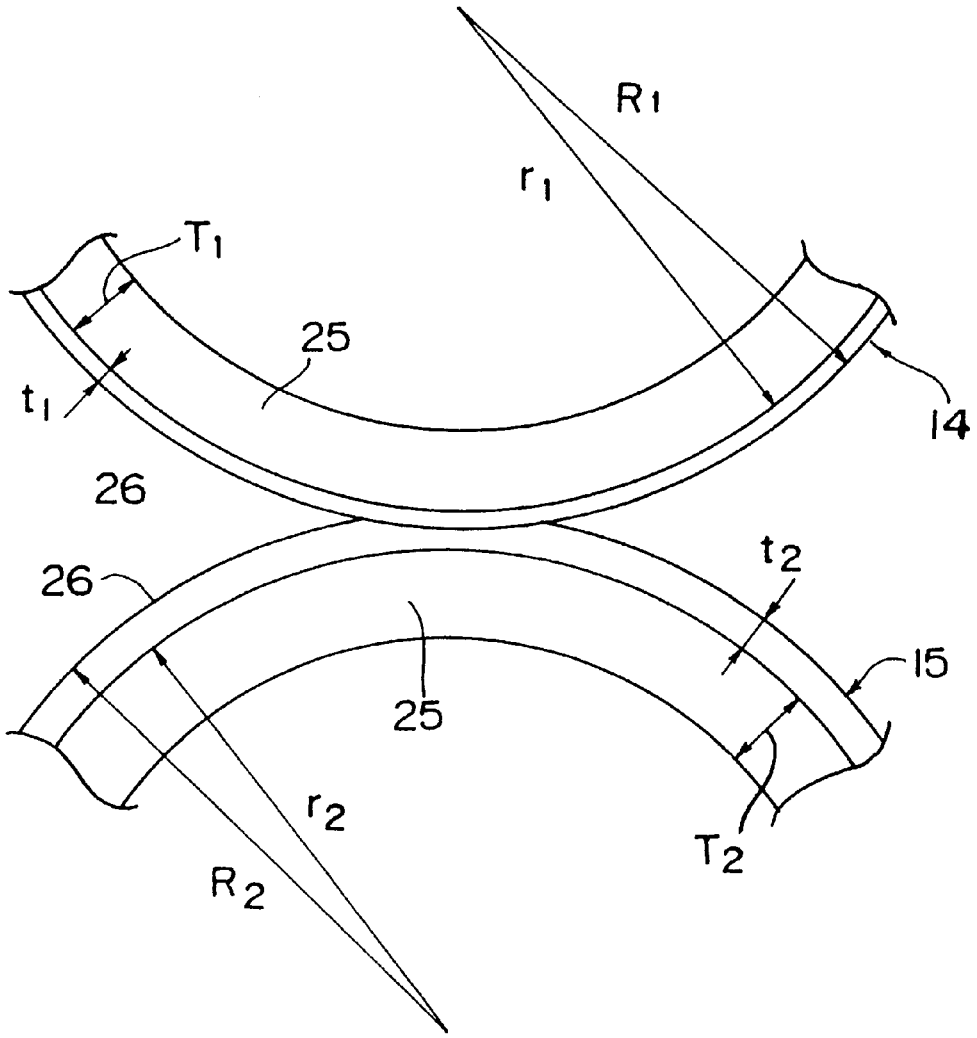
FIG. 11 is a diagram showing the fixing roller and pressure roller according to the second embodiment in abutted condition.
Figure 12:
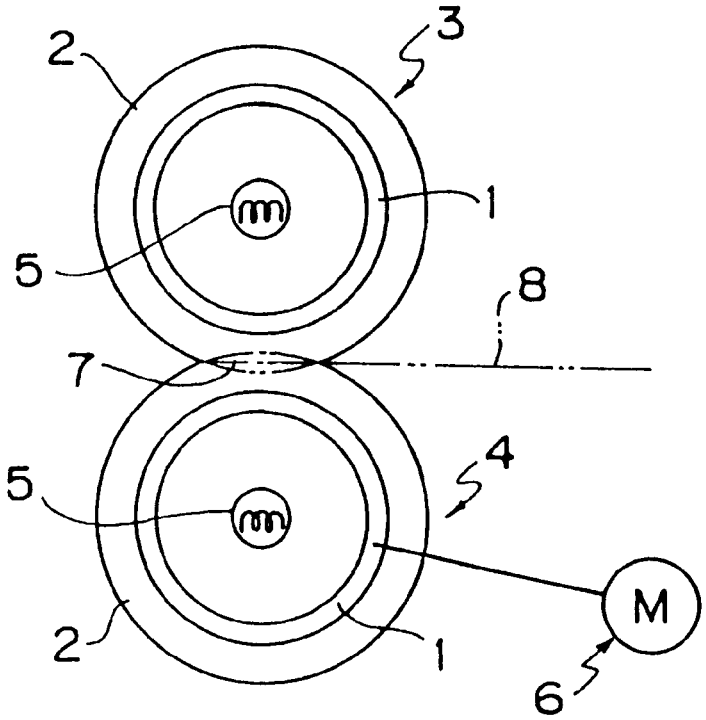
Fig.12 PRIOR ART
FIG. 12 is a schematic view showing a conventional fixing device.

FIG. 11 shows the second embodiment of the present invention.

Similarly to the first embodiment, the outer diameters R1, R2, the material and thickness $T_1$, $T_2$ of each of the metallic cylindrical bodies 25 are set to be identical for both of the fixing roller 14 and pressure roller 15, while the outer diameters $r_1$, $r_2$ of the metallic cylindrical bodies 25 are set to be different such that the thickness $t_2$ of the silicon rubber layer 26 of the pressure roller 15 which is located on a lower side in the drawing is set to be larger than the thickness $t_1$ of the silicon rubber layer 26 of the fixing roller 14 which is located on an upper side in the drawing. Further, the density of cross-link of the silicon rubber layer 26 of the pressure roller 15 having larger thickness $t_2$ is set to be smaller than that of the silicon rubber layer 26 of the fixing roller 14 having smaller thickness $t_1$. Furthermore, the roller hardness of the pressure roller 15 is set to be smaller than that of the fixing roller 14 by adjusting the amount of filler to be added to the silicon rubber layers 26. Therefore, the nip portion 32 forms a convex shape to a side of the pressure roller 15, that is, downward in the drawing.

The degree of decrease of hardness owing to thermal deterioration of the silicon rubber layer 26 is larger for the pressure roller 15 of which density of cross-link is small than that of the fixing roller 14 of which density of cross-link is large. Thus, even if decrease of hardness owing to thermal deterioration is generated, the relationship of hardness between the fixing roller 14 and pressure roller 15 is maintained, and the shape of the nip portion 32 that is convex in a downward direction is maintained.

The thermal conductivity is set such that the thermal conductivity $K_2$ of the silicon rubber layer 26 of the pressure roller 15 having larger thickness $t_2$ is larger than the thermal conductivity $K_1$ of the silicon rubber layer 26 of the fixing roller 14 having smaller thickness $t_1$. Particularly, the thermal conductivity $K_1$, $K_2$ is set to be not less than $1.2\times10^{-3}$ (cal/cm·sec·deg) and not more than $2.4\times10^{-3}$ (cal/cm·sec·deg) and to satisfy the following relationship:

$$K_1=K_2-a(t_2-t_1) \quad (6)$$

wherein (0.257<a).

This equation (6) is obtained by interchanging the thermal conductivity $K_1$ of the silicon rubber layer 26 of the fixing roller 14 with the thermal conductivity $K_2$ of the silicon rubber layer 26 of the pressure roller 15 as well as the thickness t1 of the silicon rubber layer 26 of the fixing roller 14 with the thickness $t_2$ of the silicon rubber layer 26 of the pressure roller 15 in equation (1).

Since the thermal conductivity $K_2$ of the silicon rubber layer 26 of the pressure roller 15 having larger thickness $t_2$ is set to be larger than the thermal conductivity $K_1$ of the silicon rubber layer 26 of the fixing roller 14 having smaller thickness $t_1$, it can be prevented that temperature differences are generated between the fixing roller 14 and pressure roller 15 owing to decrease in temperature of the rollers caused at the time of starting successive delivery of sheets.

Other structures and effects of the second embodiment are similar to those of the above-described first embodiment.

In a concrete example of this second embodiment, the outer diameters $R_1$, $R_2$ of the fixing roller 14 and pressure roller 15 may be set to 60 mm, the thickness $t_1$ of the silicon rubber layer 26 of the fixing roller 14 to 1.6 mm, the xylene swelling rate to 1.2, and the thermal conductivity $K_1$ to $1.2\times10^{-3}$ (cal/cm·sec·deg), while the thickness $t_2$ of the silicon rubber layer 26 of the pressure roller 15 may be set to 4 mm, the xylene swelling rate to 0.4, and the thermal conductivity $K_2$ to $2.2\times10^{-3}$ (cal/cm·sec·deg).

Although the present invention has been fully described by way of the examples with reference to the accompanying drawings, it is to be noted here that various changes and modifications will be apparent to those who skilled in the art. Therefore, unless such changes and modifications otherwise depart from the spirit and scope of the present invention, they should be construed as being therein.

What is claimed is:

1. A fixing device comprising:

first and second rollers respectively formed of a metallic cylindrical body provided with an elastic member on an outer periphery thereof, the rollers being abutted against each other so that the elastic members contact each other;

a heater for heating at least one of the first and second rollers; and a driver for rotating at least one of the first and second rollers so that a transfer sheet passes through a contact portion of the first and second rollers, wherein a certain amount of filler is added to at least one of the elastic members of the first and second rollers, and wherein thickness, cross-link density and filler amount of the elastic members of the first and second rollers are so arranged so that roller hardness of the first roller is smaller than that of the second roller, and the cross-link density of the elastic member of the first roller is lower than that of the elastic member of the second roller.

2. A fixing device as in claim 1, wherein a thickness of the elastic member of the first roller is larger than that of the elastic member of the second roller.

3. A fixing device as in claim 2, wherein thermal conductivity of the elastic member of the first roller is larger than that of the elastic member of the second roller.

4. A fixing device as in claim 3, wherein outer diameters of the first and second rollers are identical, wherein the thermal conductivity K of the elastic member having larger thickness t of the first roller and the thermal conductivity K' of the elastic member having smaller thickness t' of the second roller are not less than $1.2\times10^{-3}$(cal/cm·sec·deg) and not more than $2.4\times10^{-3}$ (cal/cm·sec·deg), and wherein the following relationship is satisfied:

$$K'=K-a(t-t'),$$

where $0.257\leqq a$.

5. A fixing device as in claim 1, wherein hardness of the elastic members of the first and second rollers is not more than 70 according to a JIS standard.

6. A fixing device as in claim 1, further comprising a switching mechanism for switching the first and second rollers between an abutted condition in which they are abutted against each other and a separate condition in which they are separated from each other.

7. A fixing device as in claim 6, wherein the switching mechanism is provided with a contact width adjusting mechanism for maintaining a width of the contact portion of the first and second rollers constant.

8. A fixing device comprising:

first and second rollers respectively formed of a metallic cylindrical body provided with an elastic member on an outer periphery thereof, the rollers being abutted against each other so that the elastic members contact each other;

a heater for heating at least one of the first and second rollers; and a driver for rotating at least one of the first and second rollers so that a transfer sheet passes through a contact portion of the first and second rollers, wherein the elastic member of the first roller has thermal conductivity and thickness larger than those of the elastic member of the second roller.

9. A fixing device as in claim 8, wherein outer diameters of the first and second rollers are identical, wherein the thermal conductivity K of the elastic member having larger thickness t of the first roller and the thermal conductivity K' of the elastic member having smaller thickness t' of the second roller are not less than $1.2\times10^{-3}$(cal/cm·sec·deg) and not more than $2.4\times10^{-3}$ (cal/cm·sec·deg), and wherein the following relationship is satisfied:

$$K'=K-a(t-t'),$$

where $0.257\leqq a$.

10. A pair of rollers to be employed in a fixing device for fixing developer onto a transfer sheet by heating the transfer sheet supporting the developer, comprising:

a first roller formed of a metallic cylindrical body provided with an elastic member on an outer surface thereof; and a second roller formed of a metallic cylindrical body provided with an elastic member on an outer surface thereof, the second roller being abutted against the first roller so that a nip portion is formed through which the transfer sheet is passed, wherein a certain amount of filler is added to at least one of the elastic members of the first and second rollers, and wherein thickness, cross-link density and filler amount of the elastic members of the first and second rollers are so arranged that roller hardness of the first roller is smaller than that of the second roller, and the cross-link density of the elastic member of the first roller is lower than that of the elastic member of the second roller.

11. A pair of rollers as in claim 10, wherein a thickness of the elastic member of the first roller is larger than that of the elastic member of the second roller.

12. A pair of rollers as in claim 11, wherein thermal conductivity of the elastic member of the first roller is larger than that of the elastic member of the second roller.

13. A pair of rollers as in claim 12, wherein outer diameters of the first and second rollers are identical, wherein the thermal conductivity K of the elastic member having larger thickness t of the first roller and the thermal conductivity K' of the elastic member having smaller thickness t' of the second roller are not less than $1.2\times10^{-3}$(cal/cm·sec·deg) and not more than $2.4\times10^{-3}$ (cal/cm·sec·deg), and wherein the following relationship is satisfied:

$$K'=K-a(t-t'),$$

where $0.257\leqq a$.

14. A pair of rollers as in claim 10, wherein hardness of the elastic members of the first and second rollers is not more than 70 according to a JIS standard.

* * * * *